United States Patent [19]

Gunji

[11] Patent Number: 4,908,663

[45] Date of Patent: Mar. 13, 1990

[54] TONER DENSITY CONTROL AND A BINDING MARGIN BY INDEX BOARD IMAGE

[75] Inventor: Kouichi Gunji, Hachiohi, Japan

[73] Assignee: Konica Corporation, Tokyo, Japan

[21] Appl. No.: 351,160

[22] Filed: May 12, 1989

[30] Foreign Application Priority Data

May 13, 1988 [JP] Japan ..... 63-117998

[51] Int. Cl.[4] ..... G03G 21/00

[52] U.S. Cl. ..... 355/218; 355/246

[58] Field of Search ..... 355/218, 313, 324, 246, 355/219, 204

[56] References Cited

U.S. PATENT DOCUMENTS

| | | | |
|---|---|---|---|
| 3,793,016 | 2/1974 | Eichorn | 355/218 X |
| 4,341,461 | 7/1982 | Fantozzi | 355/246 |
| 4,627,707 | 12/1986 | Tani et al. | 355/218 |
| 4,743,947 | 6/1988 | Yamamoto | 355/218 |
| 4,761,673 | 8/1988 | Watanabe et al. | 355/218 X |
| 4,801,975 | 1/1989 | Kano et al. | 355/218 |
| 4,806,975 | 2/1989 | Godlove et al. | 355/218 |
| 4,809,039 | 2/1989 | Ishii | 355/218 X |
| 4,819,029 | 4/1989 | Ito | 355/218 |
| 4,839,695 | 6/1989 | Yamamoto et al. | 355/218 |

*Primary Examiner*—Arthur T. Grimley
*Assistant Examiner*—Sandra L. Hoffman
*Attorney, Agent, or Firm*—Finnegan, Henderson, Farabow, Garrett and Dunner

[57] ABSTRACT

An electrophotographic copying machine includes a standard index board, a copy mode selection switch, an optical system, a photosensitive drum, an erase lamp, sheet feed rollers, and toner density adjustment switch. The standard index board is disposed adjacent to an original table. The copy mode selection switch selects a binding margin copy mode or a normal copy mode. The optical system scans the standard index board first and then scans the standard index board and an image portion of an original after the optical system returns to its home position in a binding margin copy mode. The photosensitive drum sequentially forms first and second latent images of the standard index board and a latent image of the image portion of the original thereon in response to light incident from the optical system. The erase lamp erases the second latent image of the standard index board of the latent images formed on the photosensitive drum. The sheet feeding rollers feed a transfer sheet at a timing to form a binding margin at a leading end portion of the transfer sheet. The toner density adjustment switch adjusts a toner density in accordance with the density of a standard index board image obtained by developing the first latent image of the standard index board.

5 Claims, 4 Drawing Sheets

NORMAL COPY MODE

BINDING MARGIN COPY MODE

TONER DENSITY CONTROL AND A BINDING MARGIN BY INDEX BOARD IMAGE

BACKGROUND OF THE INVENTION

The present invention relates to an electrophotographic copying machine for controlling a toner density by a standard index board image, which can form a binding margin at an upper end of an image.

When copied documents are filed or bound, it is convenient to form a binding margin at identical end portions of copied sheets. Therefore, recently, a copying machine wherein a binding margin copy mode for shifting a position of an image to be transferred to the copy sheet can be set to form a binding margin and a copying operation can be performed has been commercially available.

On the other hand, in general, a recent electrophotographic copying machine includes a standard index board at a front end portion of an original table and latent images of an original and the standard index board are respectively formed on a photosensitive body and the upper end of the original image by scanning. Then, the density of a standard index board toner image obtained by exposure is measured to control a toner density for the next copying operation.

A conventional exposure operation in a normal copy mode will be described hereinafter with reference to an arrangement of an electrophotographic copying machine shown in FIG. 1.

In FIG. 1, a scale plate 2 for designating an original position depending on the size of an original D, and an original cover 3 for covering the placed original D are located on a main body of the copying machine. A standard index board 40 having a predetermined density is arranged on the rear surface of the scale plate 2. The standard index board 40 is spaced apart from an original-side end of the scale plate 2 by an interval d (about 10 mm). A first mirror unit 6 having an exposure lamp 4 and a first mirror 5 is disposed below an original table 1 in the main body of the copying machine. The first mirror unit 6 is disposed parallel to the original table 1 and can be linearly reciprocated in FIG. 1 to optically scan the standard index board 40 arranged at the upper end of the original and the entire surface of the original D. Reference numerals 7 and 8 denote second and third mirrors. A second mirror unit 9 integrally formed with the mirrors 7 and 8 is linearly reciprocated at a half speed of the first mirror unit 6. The second mirror unit 9 is moved parallel to the original table 1 in the same manner as in the first mirror unit 6, as a matter of course. Light reflected by the standard index board 40 and the original D which are positioned on the original table 1 is reflected by the first, second, and third mirrors 5, 7, and 8, and incident on a photosensitive drum 20 serving as an image supporting member through a main lens 10, a fourth mirror 11, and a slit S.

In the copying machine having the above-mentioned exposing steps, in order to perform a copying operation with a binding margin at an upper end of the copied image (a binding margin copy mode), a feed timing of the copy sheet (transfer sheet) is advanced to advance the transfer sheet from an image on the photosensitive drum 20 by the binding margin. However, if the transfer sheet is excessively advanced, the image of the standard index board 40 is also undesirably transferred to the transfer sheet. Therefore, in the relationship between the images on the peripheral surface of the photosensitive drum 20 in FIG. 2(*a*), the interval d between a standard index board latent image 40*a* and an original latent image 41*a*, i.e., the interval d between the standard index board 40 and the distal end of the original D, must be increased to exceed at least a maximum binding margin set by a user. Therefore, when the copying machine which can set a sufficient binding margin is obtained, it is necessary to increase the interval d. For this reason, the scanning lengths of the first and second mirror units 6 and 9 are increased, and the size and cost of the copying machine are undesirably increased.

SUMMARY OF THE INVENTION

It is an object of the present invention to solve the above problems and provide an electrophotographic copying machine having a binding margin copy mode together with a normal copy mode without an increase in size and cost of the copying machine.

The above object can be achieved as follows. In an electrophotographic copying machine having a copy mode for forming a latent image of an image portion on a photosensitive body and a latent image of a standard index board at an upper end of the latent image of the image portion to control a toner density based on a developed standard index board image, wherein a binding margin copy mode is provided besides the normal copy mode, the standard index board is scanned to form the first standard index board latent image when the binding margin copy mode is selected, the second standard index board latent image and an image portion latent image are then formed after an optical system returns to its home position, and the second standard index board latent image is erased to form a binding margin.

DETAILED DESCRIPTION OF THE PREFERRED EMBODIMENTS

Embodiments of the present invention will be described hereinafter with reference to the accompanying drawings.

Figure 1:
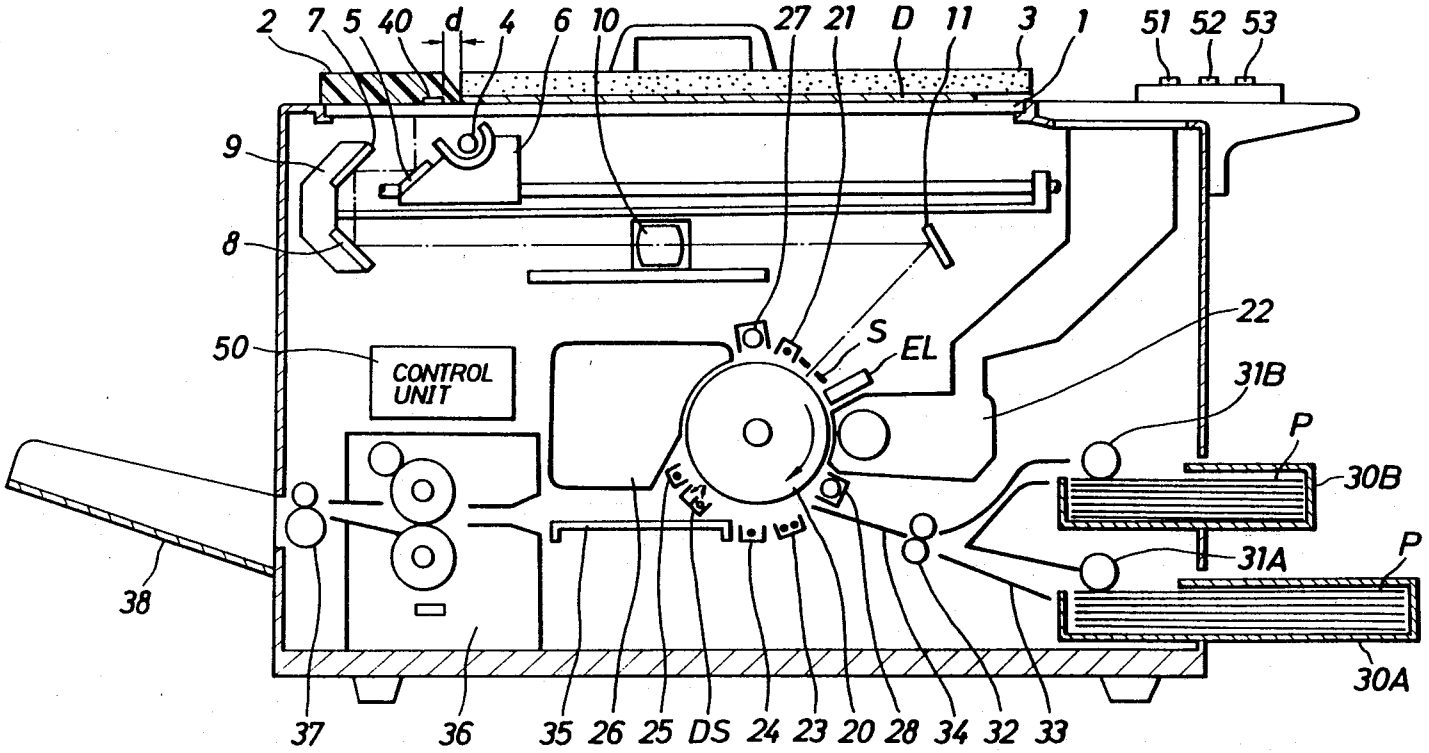
FIG. 1 is a sectional view showing an arrangement of an embodiment of the present invention.
Figure 2A:
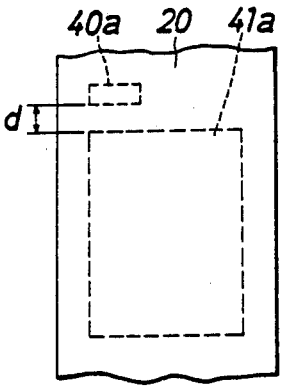
FIGS. 2(*a*) to 2(*c*) are developed views of a photosensitive drum surface in a normal copy mode.
Figure 2B:
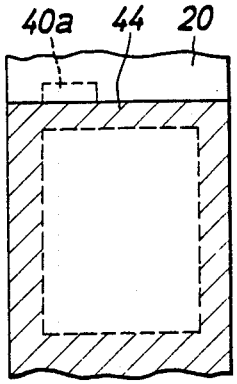
Figure 2C:
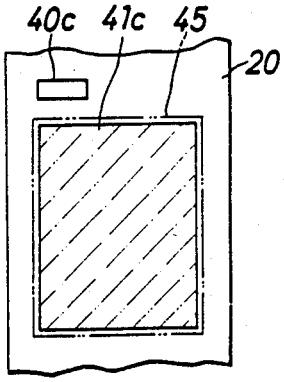
Figure 3A:
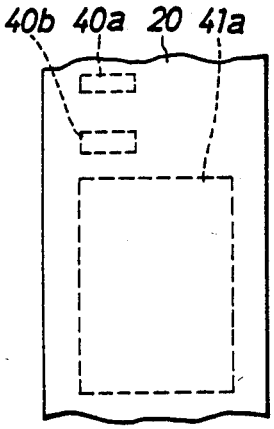
FIGS. 3(*a*) to 3(*c*) are developed views of a photosensitive drum surface in a binding margin copy mode.
Figure 3B:
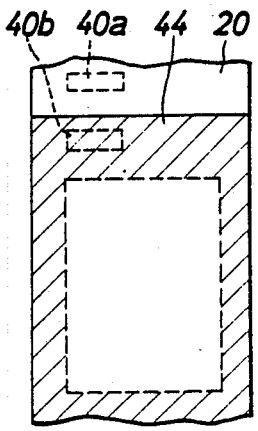
Figure 3C:
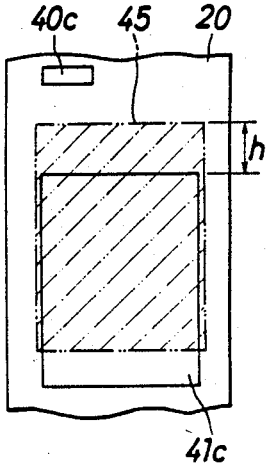
Figure 4A:
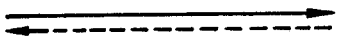
FIGS. 4(*a*) and 4(*b*) are views showing scanning tracks of a first mirror unit shown in FIG. 1 in the normal and binding margin copy modes.
Figure 4B:
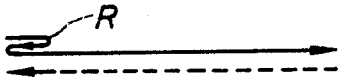

FIG. 1 is a sectional view showing an arrangement of an embodiment of the present invention, FIGS. 2(*a*) to 2(*c*) are developed views of a photosensitive drum surface in a normal copy mode, FIGS. 3(*a*) to 3(*c*) are developed views of a photosensitive drum surface in a binding margin copy mode, and FIGS. 4(*a*) and 4(*b*) are views showing scanning tracks of a first mirror unit shown in FIG. 1 in the normal and binding margin copy modes.

In FIG. 1, a scale plate 2 for designating an original position depending on the size of an original D, and an original cover 3 for covering the placed original D are located on a main body of the copying machine. A standard index board 40 having a predetermined density is arranged on the rear surface of the scale plate 2. The standard index board 40 is spaced apart from an original-side end of the scale plate 2 by about 10 mm. A first mirror unit 6 having an exposure lamp 4 and a first mirror 5 is disposed below an original table 1 in the main body of the copying machine. The first mirror unit 6 is disposed parallel to the original table 1 and can be linearly reciprocated in FIG. 1 to optically scan the standard index board 40 arranged at the upper end of the original and the entire surface of the original D. Reference numerals 7 and 8 denote second and third mirrors. A second mirror unit 9 integrally formed with the mirrors 7 and 8 is linearly reciprocated at a half speed of the first mirror unit 6. The second mirror unit 9 is moved parallel to the original table 1 in the same manner as in the first mirror unit 6, as a matter of course. Light reflected by the original D and the standard index board 40 on the original table 1 is reflected by the first, second, and third mirrors 5, 7, and 8, and incident on a photosensitive drum 20 serving as an image supporting member through a main lens 10, a fourth mirror 11, and a slit S. When the scanning is ended, the first and second mirror units 6 and 9 are returned to their home positions, and wait for the next copying operation.

The photosensitive drum 20 is rotated clockwise, as indicated by an arrow, upon start of a copying operation. After electric charges on the photosensitive drum 20 are uniformly erased by a discharge lamp 27 in advance, the drum 20 is charged by a charge electrode 21. Therefore, as shown in FIG. 2(*a*), a standard index board latent image 40*a* and an original latent image 41*a* serving as electrostatic latent images corresponding to the standard index board 40 and the original D are sequentially formed on the photosensitive drum 20 in response to light incident from the optical system. Thereafter, for example, when an LED having a light-emitting spectrum in an excellent sensitivity range of the photosensitive drum 20 approaches the surface of the photosensitive drum 20 to reach the position of discharge lamps EL linearly arranged parallel to a rotating shaft of the drum 20, the discharge lamps EL are ON/OFF-controlled, and an erase area 44 hatched in FIG. 2(*b*) is exposed to erase an electrostatic latent image on this portion. Thereafter, the standard index board latent image 40*a* and the original latent image 41*a* on the photosensitive drum 20 become a standard index board toner image 40*c* and an original toner image 41*c* serving as visual toner images by an developing unit 22.

A sheet feeding unit for feeding a transfer sheet P includes sheet cassettes 30A and 30B in which a large amount of transfer sheets P are stacked, first sheet feeding rollers 31A and 31B for feeding the transfer sheets P from the sheet cassettes 30A and 30B one by one, second sheet feeding rollers 32 for conveying each fed transfer sheet P to the photosensitive drum 20, a guide plate 33 disposed between the sheet cassettes 30A and 30B and the sheet feeding rollers 32, and a guide plate 34.

During a copying operation, each transfer sheet P in the selected sheet cassette 30A or 30B is fed by the first sheet feeding roller 31A or 31B, and guided by the guide plate 33 to reach the second sheet feeding rollers 32. The transfer sheet P is continuously fed by the second sheet feeding rollers 32 operated in response to a sheet feed timing signal in order to cause the upper end of the original toner image 41*c* on the photosensitive drum 20 to coincide with the leading end of the transfer sheet P.

Thereafter, a transfer area 45 including the original toner image 41*c* on the photosensitive drum 20 in FIG. 2(*c*) is transferred to the transfer sheet P based on the behavior of a transfer electrode 23. The transfer sheet P separated from the photosensitive drum 20 by a separating electrode 24 is conveyed to a fixing unit 36 through a transfer sheet convey means 35. The toner on the conveyed sheet P is melted and fixed by a heat fixing roller and a press roller, and the sheet having a fixed image is delivered to a delivery tray 38 by delivery rollers 37.

On the other hand, the standard index board toner image 40*c* on the photosensitive drum 20 is not transferred, and the density of the image 40*c* is measured by a densitometer DS including light-emitting and light-receiving elements. A density signal of the image 40*c* is supplied to a control unit 50 including, e.g., a microprocessor. The control unit 50 adjusts the supplying amount of the toner in response to the density signal and controls to keep the image density for the next copying operation constant. Thereafter, in order to easily remove the toner remaining on the drum by a cleaning unit 26 to be described later, the surface of the photosensitive drum 20 is electrically neutralized by a cleaning discharge electrode 25 for performing AC corona discharging. Then, the toner remaining on the drum which cannot be removed is scraped and cleaned by the cleaning unit 26 having a blade, a cleaning blush, and the like (not shown) to prepare for the next copying operation.

An operation in the binding margin copy mode will be described hereinafter.

A mode switch 51 for selecting the binding margin copy mode or the normal copy mode is arranged on an operation panel. When the binding margin copy mode is designated by the mode switch 51 and a start button 52 is depressed, the photosensitive drum 20 is rotated clockwise. A scanning optical system including the first and second mirror units 6 and 9 scans the standard index board 40, and its image is projected by the main lens 10 and the fourth mirror 11 on the photosensitive drum 20 uniformly charged in advance to form the standard index board latent image 40*a*. The control unit 50 causes the scanning optical system to temporarily return to its home position, and controls the optical system to perform scanning from the beginning. Since the photosensitive drum 20 continues its uniform rotation, a standard index latent image 40*b* and the original latent image 41*a* are formed again on the photosensitive drum 20, as shown in FIG. 3(*a*). At this time, the scanning track of the first mirror unit 6 is shown in FIG. 4(*b*). FIG. 4(*a*) is a view showing a scanning track of the first mirror unit 6 in the normal copy mode in order to compare it with that in the binding margin copy mode.

Solid and broken lines in FIGS. 4(*a*) and 4(*b*) represent forward and backward paths of the first mirror unit 6, respectively. In the binding margin copy mode, the first mirror unit 6 exposes the standard index board 40, and returns to the home position from a point R, as shown in FIG. 4(*b*). Thereafter, the first mirror unit 6 scans the standard index board 40 and the original surface again.

The control unit 50 ON/OFF-controls the discharge lamps EL to erase the erase area 44 including the standard index board latent image 40*b* formed later in FIG. 3(*b*). In addition, the control unit 50 controls an operation of the second sheet feeding rollers 32 to perform feeding at a timing such that the transfer area 45 shown in FIG. 3(*c*) is transferred. Since the above-mentioned copying operations are performed, an area h in FIG. 3(*c*) serves as a binding margin during the copying operation. Since other operations are the same as in the normal copy mode, a description thereof will be omitted.

Note that the length of the binding margin can be continuously adjusted in mm to fall within the range of 0 to 50 mm by an adjustment switch 53. This adjustment can be performed by changing the driving timing of the second sheet feeding rollers 32 in accordance with a set value of the adjustment switch 53.

Figure 5:
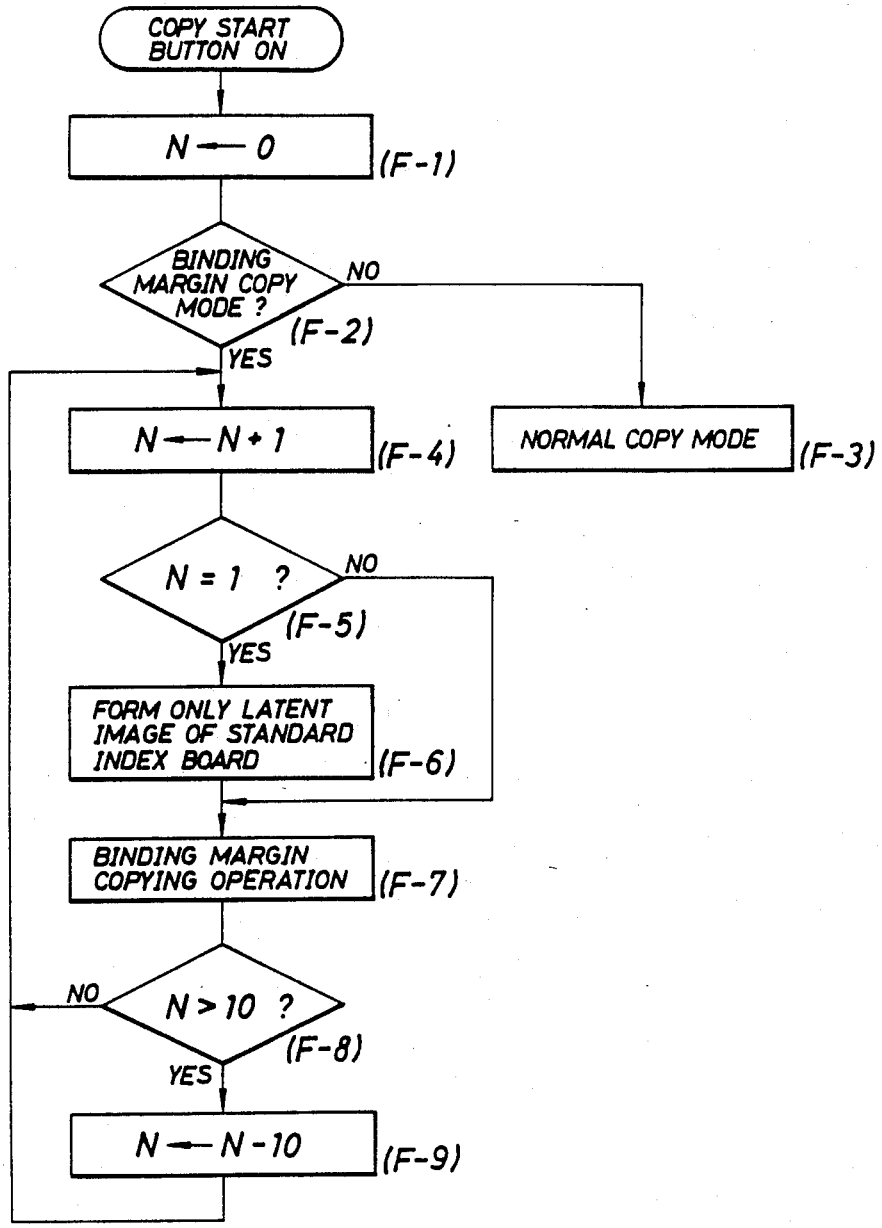
FIG. 5 is a flow chart for explaining another embodiment of the present invention.

Assume that the binding margin copying operations are continuously performed many times, if the standard index board 40 is scanned twice for each operation, copying time is undesirably increased. Therefore, a latent image of the standard index board 40 may be formed in only the first copying operation, or for every predetermined number of sheets (e.g., once for ten copy sheets). An embodiment using the latter method will be described hereinafter with reference to FIG. 5.

When a binding margin copy mode is selected, a microprocessor of a control unit 50 controls the process to check a toner density only once for ten copying operations. More specifically, first, a copy number counter N is reset (F-1), and it is determined whether or not the binding margin copy mode is selected by a mode switch 51 (F-2). If the binding margin copy mode is not selected, the above-mentioned normal copying operation is performed (F-3). When the margin copy mode is selected, the counter N is incremented (F-4), and it is determined whether the value of the counter N is "1" (F-5). If $N=1$, scanning by the optical system is performed to form only the latent image of a standard index board 40 (F-6), and the binding margin copying operation is performed (F-7). The binding margin copying operation has been described above. More specifically, the standard index board 40 and an original surface are scanned again to form their latent images on a photosensitive drum 20. Then, a second standard index latent image 40*b* is erased. Thereafter, electrophotographic processes such as image development and its transfer are executed, as a matter of course.

In step (F-5), if $N \neq 1$, the flow jumps latent image formation in step (F-6), and the binding margin copying operation is performed (F-7). In other words, a step of forming only the latent image of the standard index board 40 is omitted from the second copying operation, and a first mirror unit 6 is moved along the same scanning track as that in the normal copy mode, as shown in FIG. 4(*a*). The latent image of the standard index board 40 formed at this time is erased by discharge lamps EL.

In step (F-8), it is determined whether the value of the counter N is 10 or more (F-8). If NO in step (F-8), the flow returns to step (F-4), and the same operation is repeated until $N=10$. If $N>10$ in step (F-8), 10 is subtracted from N (F-9), and the flow returns to step (F-4).

Figure 6:
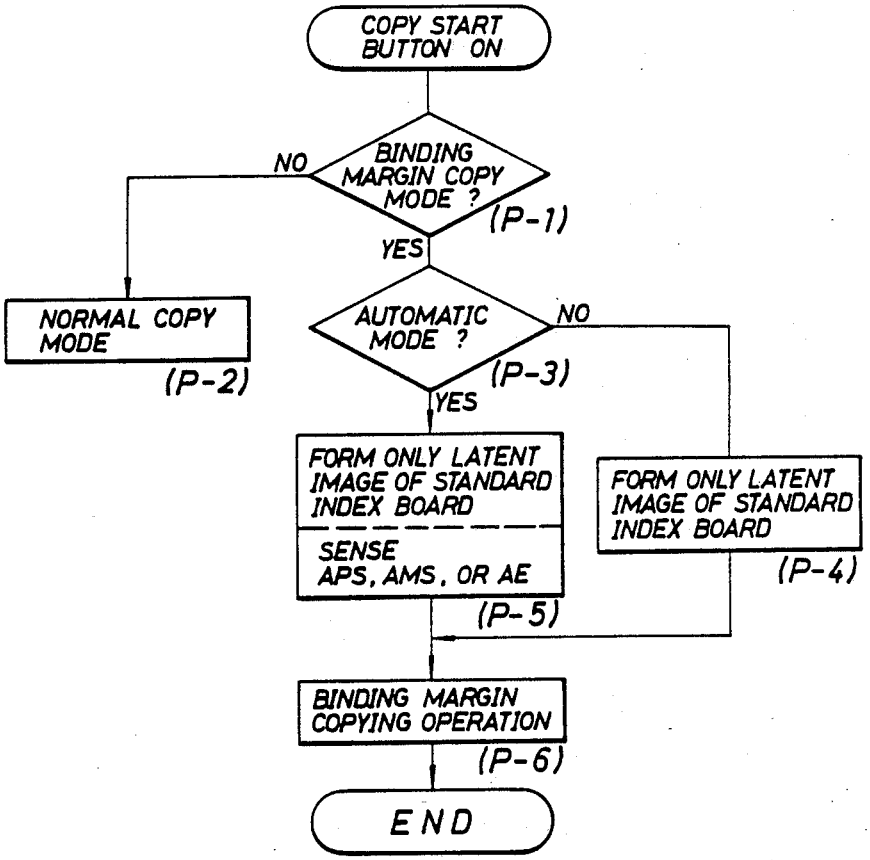
FIG. 6 is a flow chart for explaining still another embodiment of the present invention.

FIG. 6 is a flow chart for explaining still another embodiment.

Most of the recent copying machines include an automatic mode for automatically selecting copying conditions depending on originals. The automatic modes such as Automatic Paper Selection (APS) for automatically selecting a copy sheet, Automatic Magnification Selection (AMS) for automatically selecting a copying magnification, and Auto Exposure (AE) for automatically selecting a copying density have been utilized.

In the APS, for example, several yellow stripes are arranged on an original cover at predetermined intervals. The number of yellow stripes is counted by a sensor below an original table 1. However, when an original is placed on the original table 1, some yellow stripes are interrupted by the original. Therefore, the number of yellow stripes are sensed, so that an original size can be detected. A copy sheet is selected depending on the detected original size.

In the AMS, when a sheet size selected by an operator in advance is different from the original size detected by the above-mentioned method, it is determined that an enlargement or reduction copying operation is performed, and a magnification is automatically set depending on the copy sheet.

In the AE, the optical system is moved and the reflected light is received by a sensor. An image density of the original is detected based on an output value from the sensor. The copy density is automatically set in accordance with the detected density.

In the above-mentioned automatic modes, predetermined scanning by the optical system is performed prior to the actual copying operation, and the size or density of the original is detected. However, when the binding margin mode according to the present invention is set in the apparatus of this type, the scanning for detecting the size or density of the original is performed before the optical system performs scanning to form only the latent image of the standard index board 40. Therefore, the copying time is further increased.

In this embodiment, when the binding margin copy mode is selected, the size or density of the original is detected simultaneously with scanning of the optical system to form only the latent image of the standard index board 40. Therefore, the copying time is not increased even if the automatic mode is selected.

FIG. 6 is a flow chart for explaining an operation of this embodiment. This operation is controlled by a microprocessor in a control unit 50.

When a copy start button is depressed, it is determined whether the binding margin copy mode is selected by a mode switch 51 (P-1). If the binding margin copy mode is not selected, the normal copying operation is performed (P-2). If the binding margin copy mode is selected, it is determined whether the automatic mode is selected (P-3). If the automatic mode is not selected, only the latent image of the standard index board 40 is formed (P-4), and the binding margin copying operation is performed (P-6). The binding margin copying operation is the same as the above-mentioned operation in step (F-7) shown in FIG. 5.

In the automatic mode (P-3), the size or density of the original is detected simultaneously with formation of only the latent image of the standard index board 40 (P-5). Thereafter, the binding margin copying operation is performed (P-6).

As has been described above, in this embodiment, since the size or density of the original is sensed at the same time that the latent image of the standard index board 40 is formed, the copy time is not increased.

According to the present invention, as has been described above, the binding margin copy mode is provided. Therefore, there is provided an electrophotographic copying machine including the binding margin copy mode which can set a binding margin having a desired size besides the normal copy mode, without an increase in size of the main body of the copying machine regardless of a maximum binding margin set by a user and, in particular, without an increase in cost.

What is claimed is:

1. An electrophotographic copying machine comprising:

a standard index board disposed adjacent to an original table;

copy mode selecting means for selecting a binding margin copy mode or a normal copy mode;

an optical system for scanning said standard index board, and then scanning said standard index board and an image portion of an original after said optical system returns to a home position in a binding margin copy mode;

a photosensitive body for sequentially forming first and second latent images of said standard index board and a latent image of said image portion of the original thereon in response to light incident from said optical system;

erasing means for erasing the second latent image of said standard index board of the latent images formed on said photosensitive body;

sheet feeding means for feeding a transfer sheet at a timing to form a binding margin at a leading end portion of the transfer sheet; and toner density control means for adjusting a toner density in accordance with the density of a standard index board image obtained by developing the first latent image of said standard index board.

2. A copying machine according to claim 1, further comprising adjusting means for changing a sheet feed timing of said sheet feeding means to adjust the length of the binding margin.

3. A copying machine according to claim 1, further comprising means for inhibiting scanning of said optical system to form the first latent image from a second copying operation when a plurality of copying operations are performed in a binding margin copy mode.

4. A copying machine according to claim 1, further comprising means for inhibiting scanning except for scanning of said optical system to form the first latent image every predetermined number of copying operations when a plurality of copying operations are performed in the binding margin copy mode.

5. A copying machine according to claim 1, further comprising means for setting an automatic sheet size selection mode, an automatic magnification selection mode, or an automatic copy density selection mode, and for detecting the size and density of an original depending on a selected mode during the scanning of said optical system to form the first latent image.

* * * * *